US006485335B1

(12) United States Patent
Dewdney

(10) Patent No.: US 6,485,335 B1
(45) Date of Patent: Nov. 26, 2002

(54) ELECTRICAL CONNECTION

(75) Inventor: Guy James Ashley Dewdney, Slough (GB)

(73) Assignee: Smiths Industries Public Limited Company (GB)

( * ) Notice: Subject to any disclaimer, the term of this patent is extended or adjusted under 35 U.S.C. 154(b) by 0 days.

(21) Appl. No.: 09/401,323

(22) Filed: Sep. 23, 1999

(30) Foreign Application Priority Data

Oct. 3, 1998 (GB) ..... 9821511

(51) Int. Cl.[7] ..... H01R 9/03
(52) U.S. Cl. ..... 439/610; 439/578; 439/98
(58) Field of Search ..... 439/610, 607, 439/578, 580, 108, 98, 579, 585

(56) References Cited

U.S. PATENT DOCUMENTS

| | | | | |
|---|---|---|---|---|
| 4,051,323 A | | 9/1977 | Churla | |
| 4,329,537 A | | 5/1982 | Mangrobang et al. | |
| 5,364,292 A | * | 11/1994 | Bethurum | 439/610 |
| 5,718,607 A | * | 2/1998 | Murphy et al. | 439/610 |
| 5,769,665 A | * | 6/1998 | Neely et al. | 439/610 |
| 5,775,924 A | * | 7/1998 | Miskin et al. | 439/98 |
| 5,823,825 A | * | 10/1998 | Murphy | 439/610 |
| 5,934,818 A | * | 8/1999 | Schmitt et al. | 403/399 |
| 5,961,348 A | * | 10/1999 | Murphy | 439/579 |
| 5,962,812 A | * | 10/1999 | Miyazaki | 174/78 |
| 5,994,646 A | * | 11/1999 | Broeksteeg et al. | 174/74 R |
| 6,095,828 A | * | 8/2000 | Burland | 439/98 |
| 6,095,829 A | * | 8/2000 | Burland | 439/98 |
| 6,129,581 A | * | 10/2000 | Lee | 439/497 |

FOREIGN PATENT DOCUMENTS

| | | |
|---|---|---|
| FR | 1.361.621 | 5/1964 |
| FR | 2.586.865 | 3/1987 |
| FR | 1.574.170 | 7/1999 |

* cited by examiner

*Primary Examiner*—Tho D. Ta
*Assistant Examiner*—Edwin A. León
(74) *Attorney, Agent, or Firm*—Connolly Bove Lodge & Hutz LLP

(57) ABSTRACT

A connector for a bundle of screened wires has grounding wires connecting the housing with the screens of the wires. Each screen projects in a tubular portion of a respective metal connection device together with one end of a grounding wire. The tubular portion is crimped to a C-shape in section so that it lies closely against the wire. A support tail of concave section extends rearwardly from the tubular portion and is attached to the outside of the wire.

9 Claims, 2 Drawing Sheets

ELECTRICAL CONNECTION

BACKGROUND OF THE INVENTION

This invention relates to electrical connection.

The invention is more particularly concerned with devices and methods for making connection to screening shields and braided sleeves, and with connectors including connection to an electrical shield of a wire.

In electrical connectors, couplings or the like having many screened wires, it can be very difficult to make effective electrical connection with the screening sleeves of the wires whilst retaining a compact configuration of the connector.

BRIEF SUMMARY OF THE INVENTION

It is an object of the present invention to provide alternative electrical connection.

According to one aspect of the present invention there is provided an assembly of an electrical wire including at least one conductor and a screening sleeve surrounding the conductor, and a connection device connected with the screening sleeve, the connection device having a tubular portion crimped securely about the screening sleeve to form a concave surface on a side of the portion facing the wire.

The connection device preferably includes an elongate support member extending rearwardly of the tubular portion. The elongate support member preferably has a concave surface facing the wire and the support member may be attached to the outside of the wire. The assembly preferably includes a grounding wire, a part of the grounding wire being crimped in the tubular portion of the connection device to make electrical connection with the screening sleeve. The assembly preferably includes an electrically-conductive housing and a plurality of screened electrical wires, the screen on each wire being electrically connected with the housing by a respective one of the connection devices. The connection devices may be electrically connected with the housing by respective grounding wires one end of which is crimped in the tubular portion of each connection device. The connection devices may be staggered along the length of the wires.

According to another aspect of the present invention there is provided a connection device for an assembly according to the above one aspect of the invention.

According to a third aspect of the present invention there is provided an electrical connector including an electrically-conductive housing, a bundle of a plurality of screened electrical wires and a plurality of grounding wires electrically connected at one end with the housing, the screen on each screened wire being electrically connected with a respective one of the grounding wires by means of a respective connection device having a forward tubular portion and a rearwardly-extending support member, the screen of each wire being separated from the wire and crimped with the opposite end of a respective grounding wire in the tubular portion of a connection device such as electrically to connect the screen with the grounding wire, the tubular portions being crimped into a substantially C-shape in section so that they lie closely against the wires with the support members extending rearwardly along the wires, and the support members being secured with the wires.

According to a fourth aspect of the present invention there is provided a method of making connection to a screening sleeve of a wire including the steps of separating a length of the sleeve from the conductor of the wire, threading a part at least of the length of the screening sleeve into a tubular portion of a connection device and crimping the tubular portion securely about the sleeve into a generally C-shape section having a concave surface facing the wire.

The connection device preferably includes an elongate support member extending rearwardly of the tubular portion, the method including the step of securing the elongate member against the wire. The method may include the step of inserting one end of a grounding wire in the connection device prior to crimping so that the grounding wire makes electrical connection with the screening sleeve.

According to a fifth aspect of the present invention there is provided a connection made by a method according to the above fourth aspect of the invention.

An electrical connector including a connection device, and its method of connection, according to the present invention, will now be described, by way of example, with reference to the accompanying drawings.

DETAILED DESCRIPTION OF THE PREFERRED EMBODIMENT

Figure 1:
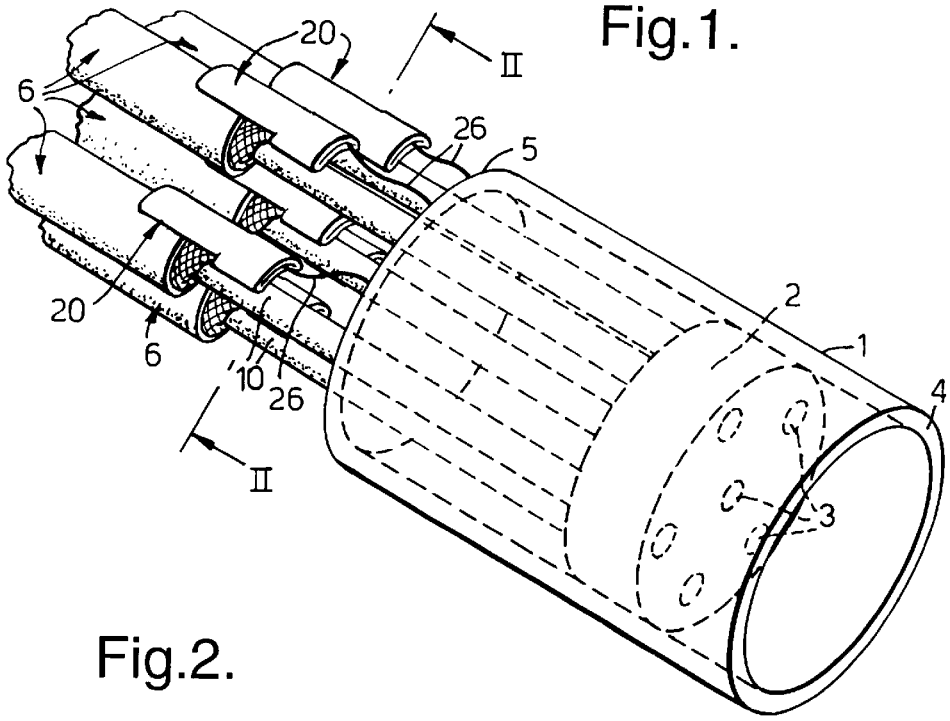
FIG. 1 is a simplified perspective view of the connector.
Figure 2:
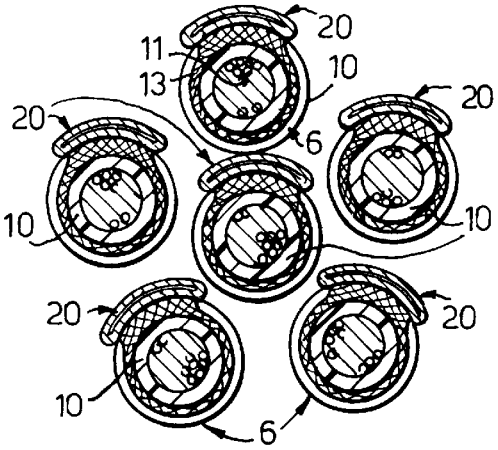
FIG. 2 is a transverse cross-section through the connector along the line II—II in FIG. 1.
Figure 4:
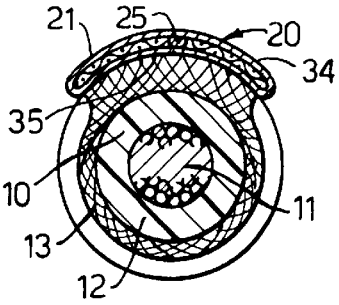
FIG. 4 is an enlarged transverse cross-section along the line IV—IV in FIG. 3.

The connector includes an outer metal housing 1 of tubular shape containing an electrically-insulative insert 2, which supports a number of contact elements 3, such as pins or sockets of conventional form. The connector housing 1 is open at its forward end 4 to receive a mating connector (not shown) and is open at its rear end 5 for access by six electrical cables 6, which are connected with respective ones of the contact elements 3. The housing 1 could be of other electrically-conductive materials, such as coated plastics.

The cables 6 are of conventional form, each including a wire 10 having a signal conductor 11 and an insulating sleeve 12 extending along the outside of the wire. A braided metal filament screening sleeve 13 extends around the wire 10 within an outer insulating jacket 14, which completes the cable. Alternatively, each cable could include several wires within the same screening sleeve, such as a twisted pair of wires.

Figure 3:
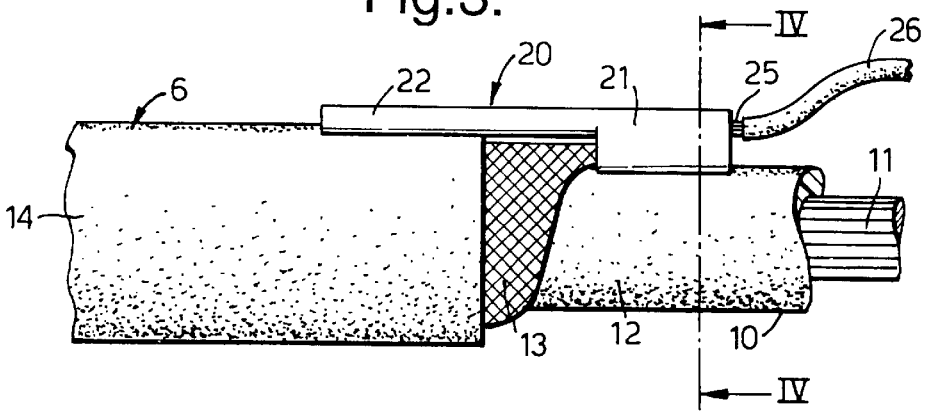
FIG. 3 is a side elevation view of one cable in the connector with a connection device.

The jacket 14 at the forward end of each cable 6, where it enters the housing 1, is stripped back to expose the screening sleeve 13, a length of which is separated from the wire 10 to one side, as shown most clearly in FIG. 3. Similarly, the insulating sleeve 12 on each wire 10 is stripped off along a short distance at the forward end to enable connection with respective contact elements 3 in any conventional manner. Each screening sleeve 13, where it is separated from the wire 10, supports a connection device 20 by which the sleeves are electrically connected to the connector housing 1.

Figure 5:
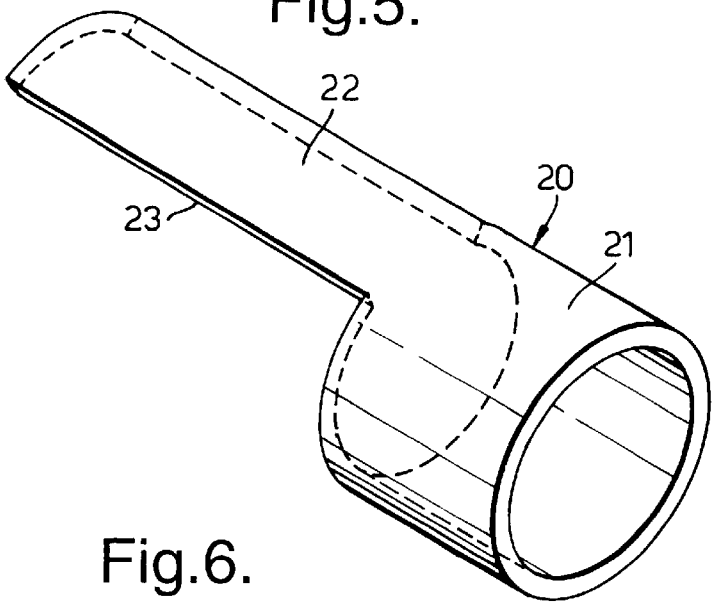
FIG. 5 is a perspective view of the connection device before crimping.
Figure 6:
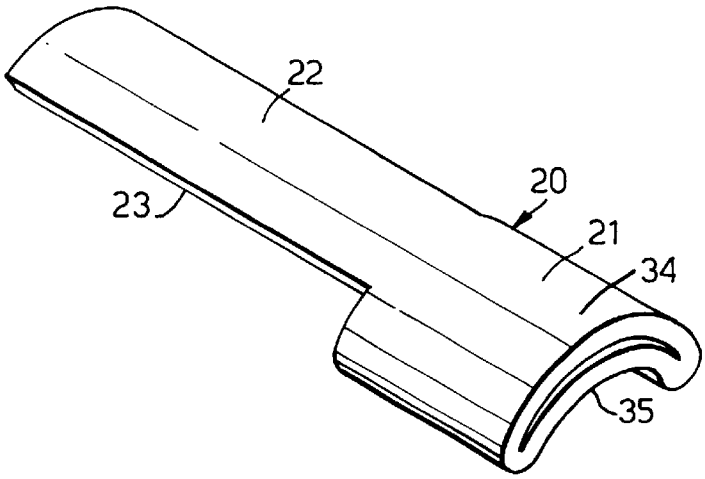
FIG. 6 is a perspective view of the connection device after crimping.

The connection device 20 is made of a malleable, crimpable metal, such as copper, brass, annealed stainless steel or a similar chemically-stable material. The connection device 20 comprises a forward portion 21 and a rear tail portion 22 integrally formed with the forward portion. As shown in FIG. 5, the forward portion 21 is initially of tubular shape and circular section, typically being about 3 mm long and having an external diameter of 3 mm. The tubular portion 21 could be of other substantially circular sections, such as oval or the like. The tail portion 22 provides an elongate support member and is in the form of a strip about 8 mm long and 2 mm wide, curved across its width to form a continuation of the wall of the forward portion 21 and to provide a concave, inwardly-facing surface 23.

An assembly of the connection device 20 on a wire 10 is formed by threading the connection device on the separated end of the screening sleeve 13 such that the screening sleeve just protrudes from the forward end of the tubular portion 21. The tail portion 22 projects rearwardly along the insulating jacket 14 and is preferably bonded to it, such as with an adhesive or the like. At the same time, the rear, exposed end 25 of an insulated grounding wire 26 is also threaded into the tubular portion 21 of the connection device 20 from its forward end so that it just protrudes from the rear end of the tubular portion. The other end of each grounding wire 26 is connected to the housing 1 in some conventional way, such as by soldering or by mechanical connection.

Figure 7:
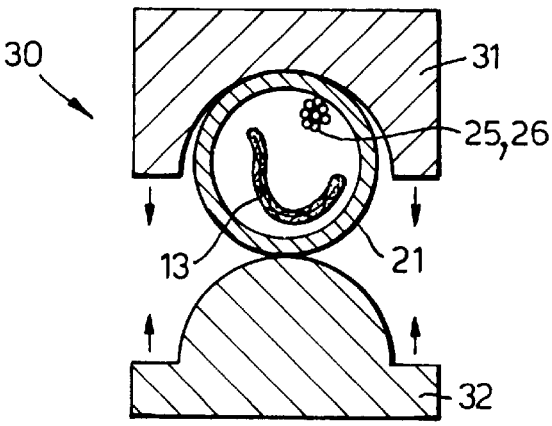
FIG. 7 illustrates the method of crimping the connection device.

A crimping tool 30 with opposite concave and convex jaws 31 and 32 is then positioned about the tubular portion 21, as shown in FIG. 7, with the tail portion 22 being aligned centrally of the concave jaw. The jaws 31 and 32 are squeezed together to crimp the tubular portion 21 about both the screening sleeve 13 and the end 25 of the grounding wire 26. This crimping deforms the tubular portion 21 into a generally C-shape transverse section with a convex surface 34 on one side, facing the wire 10, and a concave surface 35 on the opposite side, facing away from the wire. The reduced volume within the tubular portion 21 after crimping forms a secure mechanical retention of both the screening sleeve 13 and the grounding wire 26 and also provides an effective electrical connection between the screening sleeve and the grounding wire. The alignment of the crimping tool 30 is such that the tail portion 22 forms a continuation of the convex surface 34 and such that the concave surface 35 faces towards the wire 10, lying against the insulating sleeve 12 of the wire, the radius of curvature of this surface being selected such that it is equal to or slightly larger than that of the insulating sleeve, so that the crimped portion lies closely against the insulating sleeve. The convex surface 34 faces away from the wire 10. The tail portion 22 of each connection device 20 provides it with mechanical support.

Connection devices 20 are crimped to all six of the cables 6 but, because of their compact shape, they do not significantly add to the bulk of the cable bundle. If necessary, the connection devices could be staggered at different locations along the length of the cable bundle to reduce the lateral bulk at any one point. The connection devices 20 are held in place by adhesive tape (not shown) wrapped around each device on its respective cable.

Various modifications are possible to the arrangement described above. For example, the grounding wire need not be crimped in the tubular portion with the sleeve but could be attached with the connection device at some other point in some other way, such as by soldering. Instead of a grounding wire, the connection devices could be electrically connected with the housing in other ways, such as by direct contact. The screening sleeve of the cables need not be braided but could be of some other form capable of being gripped in the crimped tubular portion, such as, for example, a mesh or a flexible tube or foil.

What I claim is:

1. An assembly comprising: a plurality of electrical wires, each said wire including at least one conductor, an insulating sleeve extending over the conductor and a screening sleeve surrounding the insulating sleeve along a part of its length and separated from the insulating sleeve towards one end to one side of the insulating sleeve; and a connection device for each said wire, each said connection device including a tubular portion, said tubular portion being crimped securely about said screening sleeve over a respective end where it is separated from the insulating sleeve to form an electrical connection therewith, wherein the crimp forms a concave surface on a side of said portion, wherein each said connection device includes an elongate support member extending rearwardly of said tubular portion, wherein each said connection device lies against the insulation sleeve of a respective wire with said concave surface facing said insulating sleeve and with said support member extending rearwardly of said tubular portion to align the connection members longitudinally, and wherein each said connection device is connected to a flexible grounding wire by which the screening sleeves are grounded.

2. An assembly according to claim 1, wherein each said elongate support member has a concave surface facing said wire.

3. An assembly according to claim 1, wherein each said support member is attached to an outside of said wire.

4. An assembly according to claim 1, wherein a part of said grounding wires are crimped in a respective tubular portion of said connection devices to make electrical connection with respective screening sleeves.

5. An assembly according to claim 1 including an electrically-conductive housing, and wherein the screen on each said wire is electrically connected with said housing by a respective one of said connection devices.

6. An assembly according to claim 5 including a plurality of grounding wires, wherein one end of each said grounding wire is crimped in a tubular portion of a respective connection device and another end of said grounding wires is electrically connected with said housing.

7. An assembly according to claim 5 wherein said connection devices are staggered along the length of said wires.

8. An electrical connector comprising: an electrically-conductive housing; a plurality of electrical wires, each said wire including at least one conductor and a screening sleeve surrounding the conductor along a part of its length and separated from the conductor towards one end and to one side thereof; and a plurality of connection devices, wherein each said connection device includes a tubular portion and an elongate support member, wherein the tubular portion of each said connection device is crimped securely about a respective one of said screening sleeves over said end where it is separated from the conductor to form an electrical connection therewith, wherein the crimp forms a concave surface on a side of said portion, and wherein each said connection device lies against a respective wire with said concave surface facing said wire and with said elongate support member extending rearwardly to align the connection members longitudinally, and wherein each said connection device is connected to a flexible grounding wire by which the screening sleeves are grounded.

9. An electrical connector according to claim 8, wherein said grounding wires are connected to said connection devices by crimping.

* * * * *